US007017647B2

(12) United States Patent
Bland

(10) Patent No.: US 7,017,647 B2
(45) Date of Patent: Mar. 28, 2006

(54) METHOD FOR CASTING OBJECTS WITH AN IMPROVED HUB CORE ASSEMBLY

(75) Inventor: Michael A. Bland, Pickerington, OH (US)

(73) Assignee: Amsted Industries Inc., Chicago, IL (US)

( * ) Notice: Subject to any disclaimer, the term of this patent is extended or adjusted under 35 U.S.C. 154(b) by 0 days.

(21) Appl. No.: 10/845,898

(22) Filed: Apr. 29, 2004

(65) Prior Publication Data

US 2005/0241794 A1 Nov. 3, 2005

(51) Int. Cl.
*B22D 33/04* (2006.01)

(52) U.S. Cl. ..... 164/137; 164/340

(58) Field of Classification Search ..... 164/137, 164/121, 122, 339, 340
See application file for complete search history.

(56) References Cited

U.S. PATENT DOCUMENTS 1,908,741 A * 5/1933 Fahrenwald ..... 295/30
2,838,816 A * 6/1958 Strom ..... 249/56
2,839,802 A * 6/1958 Bean et al. ..... 164/136
2,990,592 A * 7/1961 Hursen ..... 164/155.4

* cited by examiner

*Primary Examiner*—Len Tran
(74) *Attorney, Agent, or Firm*—Edward J. Brosius

(57) ABSTRACT

A method of casting an object, usually a railroad wheel, is provided. A graphite mold having a drag section and a cope section has an opening in the drag section allowing molten metal to be fed upwardly by pressure into the cast object cavity. A stopper pipe assembly extends through centrally located openings in the cope section and the drag section. The hub core seals against an opening in the drag section upon cessation of pouring to keep molten metal in the cavity in the mold. The hub core assembly is comprised of refractory material which the molten metal contacts thereby allowing the reuse of the hub core assembly.

17 Claims, 3 Drawing Sheets

METHOD FOR CASTING OBJECTS WITH AN IMPROVED HUB CORE ASSEMBLY

BACKGROUND OF THE INVENTION

The present invention relates to a method for casting objects, and more particularly, a method for casting railroad wheels using an improved hub core assembly.

The preferred method for manufacturing cast steel railroad wheels is a bottom pressure casting foundry operation wherein molten steel under pressure is forced upwardly into a machined graphite mold. The mold is thereby filled with molten steel from the bottom upwardly. This bottom pressure casting operation eliminates many of the concerns associated with traditional top pouring of molten steel into molds in foundry operations such as splashing and insufficient filling.

In the bottom pressure casting of railroad wheels, the top half or cope of the mold is usually a graphite block wherein the top portion or front face of the object beign cast is machined. The bottom half or drag of the mold is also usually a graphite block wherein the bottom portion or rear face of the object being cast is machined. A radially central opening is present in the cope section of the mold, and a complimentary radially central opening is present in the drag of the mold. When the cope section and drag section are combined to form a complete mold, such complete mold is positioned at a pouring station wherein molten steel is forced upwardly into the cavity in the mold to form the railroad wheel. As set forth in detail in U.S. Pat. No. 5,919,392, a ladle of molten steel is placed within a holding tank, and the tank is covered in a manner to seal the ladle in the holding tank. A pouring tube extends downwardly into the molten steel in the ladle and also extends upwardly to the top of the structure at the pouring station. Such pouring tube is typically comprised of a ceramic material as it must withstand the temperatures of the molten steel.

A stopper pipe is positioned in the central opening in the cope and drag sections of each graphite mold. Such stopper pipe includes a metal, usually steel, pipe section and an end stopper head, which is usually comprised of a refractory material such as a resin set sand. Upon the pressurization of the holding tank, the molten steel is forced upwardly through the pouring tube and into the mold cavity to form the railroad wheel. A plurality of risers are usually provided in the cope section of the mold such that additional molten metal can be held as necessary to downwardly fill into the mold during cooling and solidification of the railroad wheel just after pouring. Upon filling of the mold cavity and risers, the pressure is decreased to stop the metal pouring while simultaneously the stopper pipe is extended downwardly to have the end stopper head engage and seal the opening at the bottom of the mold cavity in the drag section. The graphite mold is then moved from the pouring station allowing sufficient time for the steel to solidify before the cope and drag sections are separated.

It is understood that a separate stopper pipe is required for each graphite mold, since the molten metal of the object being cast, usually a railroad wheel, comes in contact with the metal section of the stopper pipe, thereby engaging and melting it. This area of the object being cast, typically a railroad wheel, is subsequently removed to form the hub section of the railroad wheel.

It is desirable to eliminate the use of a separate stopper pipe for each object being cast in the graphite mold.

SUMMARY OF THE INVENTION

Accordingly, it is an object of the present invention to provide an improved hub core assembly for use in a bottom pressure casting operation.

It is another object of the present invention to provide an improved method for casting railroad wheels utilizing a bottom pressure casting operation with a machined graphite mold wherein a reusable hub core assembly is utilized.

The graphite mold used in the bottom pressure casting of an object such as a steel railroad wheel is comprised of a top section or cope and a bottom section or drag. The cavity to form the object being cast is typically machined into the cope section and drag section. When assembled, the cope section and drag section provide a mold ready to accept molten steel through an in gate located at the bottom center of an opening in the drag section. The top of the cope section usually includes a plurality of risers to hold molten metal for an extended period to allow the sufficient filling of the mold during cooling and solidification of the railroad wheel just after pouring.

A hub core assembly is provided in the opening of the axially central located opening in the cope section and drag section of the mold. Such hub core assembly includes a metal, usually steel, stopper pipe shaft section. Such pipe shaft section is usually a cylindrical steel pipe. A hub core is attached near the bottom end of the pipe shaft. The pipe shaft passes through the opening in the cope section and downwardly toward the bottom of the object cavity in the drag section of the mold. Such hub core is of a diameter greater than the in gate extending upwardly through the drag section of the mold. It is usual for the hub core to be cylindrical in form, as it forms the ultimate hub opening in the axial center of the railway wheel. Such hub core is usually comprised of an improved or specialty refractory material, such as an improved sand or other refractory coated with a selected resin.

The bottom of the hub core is usually of a generally cylindrical configuration and of a diameter greater than the diameter of the in gate extending upwardly through the drag section of the mold. The hub core bottom is shaped and designed to fit against the centrally located in gate cavity in the drag section of the mold, such that a seal can be formed with the downward movement of the hub core assembly by positioning the hub core against the in gate at the bottom of the cavity in the drag section of the mold. Such movement of the hub core downwardly to seal the in gate is usually simultaneously performed with the cessation of pressurization of the molten steel that is forced upwardly through the in gate and into the mold cavity.

The use of the hub core with the pipe shaft allows the hub core assembly to be reused for multiple pouring operations. The molten steel would not contact the metal pipe shaft section but rather would only contact the hub core, which is comprised of a refractory material. Such reuse of the hub core assembly results in a cost saving as compared to a one time use of the prior art stopper pipe assembly.

An additional advantage of the use of the improved hub core assembly is that the hub core itself is of a radius greater than the stopper pipe. Accordingly, less molten steel is needed to fill the cavity in the graphite mold. As this central portion of railroad wheel casting is subsequently removed for formation of the hub to receive the railroad axle, it is advantageous to use less steel to initially form the railroad wheel hub area as such excess steel ends up being removed in subsequent finishing operations.

Another advantage is that the hub core itself usually includes a hollow central portion. Accordingly, molten steel can enter the central portion through openings in the wall of the hub core to form a hub core riser of molten steel.

DETAILED DESCRIPTION OF THE PREFERRED EMBODIMENT

Figure 1:
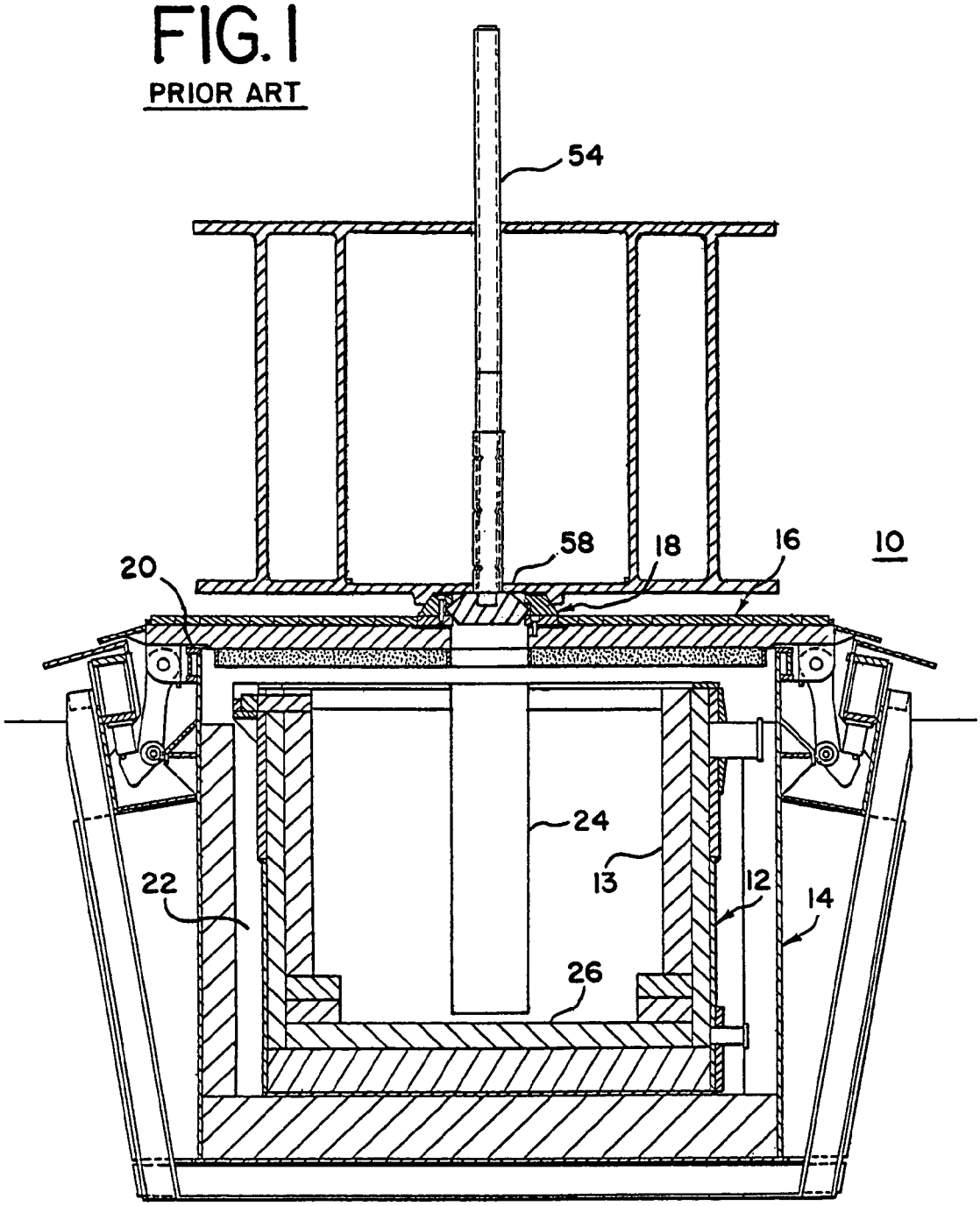
FIG. 1 PRIOR ART
FIG. 1 is a perspective view, and partial cross section, of a pouring tank and a prior art mold assembly for the bottom pressure casting of a railroad wheel.
Figure 2:
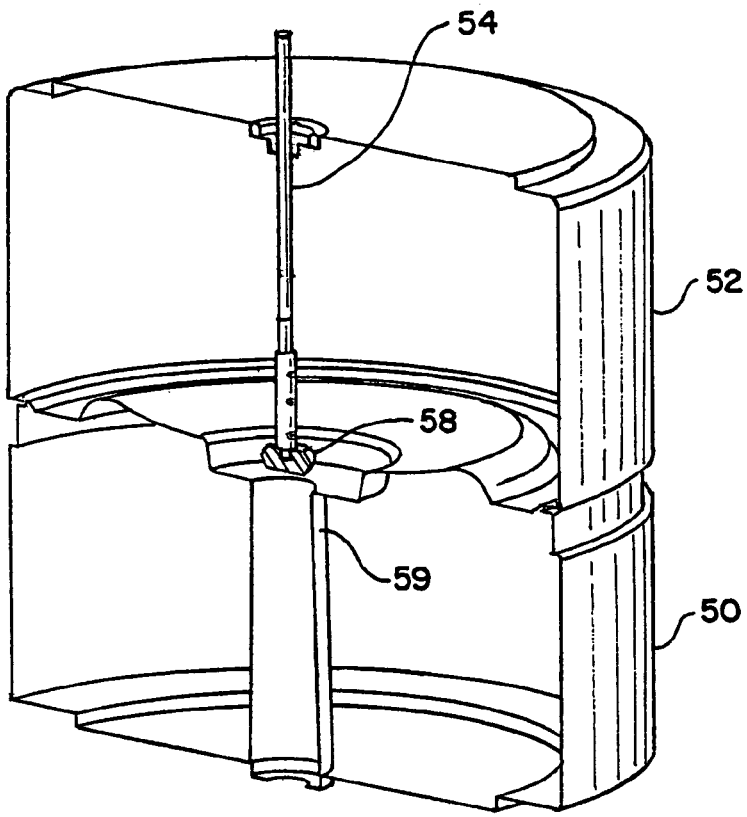
FIG.2 PRIOR ART
FIG. 2 is a perspective view of a prior art mold assembly with a stopper pipe assembly for the bottom pressure casting of a railroad wheel.

Referring now to FIGS. 1 and 2, a prior art bottom pressure casting ladle, tank and mold assembly is shown generally at 10. Ladle 12 is placed within holding tank 14. Tank cover 16 and pouring tube assembly 18 are positioned on tank top 20 in a manner to seal chamber 22. Pouring tube 24 extends from tank cover 16 into ladle 12 to near ladle bottom 26. It is understood that molten metal, typically steel, is held in ladle 12 and accordingly, ladle 12 is seen to be lined with refractory brick 13. Pouring tube 24 itself is usually comprised of a ceramic material.

In an actual pouring operation, pressurized air or an inert gas is injected under pressure into chamber 22 thereby forcing molten metal upwardly through pouring tube 24 into drag section 50 of the mold. Cope section 52 is placed on top of drag section 50 to provide a complete mold assembly. In the bottom pressure casting of steel railway wheels, drag section 50 and cope section 52 are usually comprised of graphite material, with the wheel cavity machined therein.

Upon the filling of the wheel cavity with molten steel, the pressure is reduced in chamber 22 and stopper head 58, at the end of stopper pipe shaft 54, is lowered downwardly into an engaging relationship with a complimentary opening 59 at the top of drag section 50. Such downward movement of stopper head 58 acts to seal the molten steel in the machined cavity.

Figure 3:
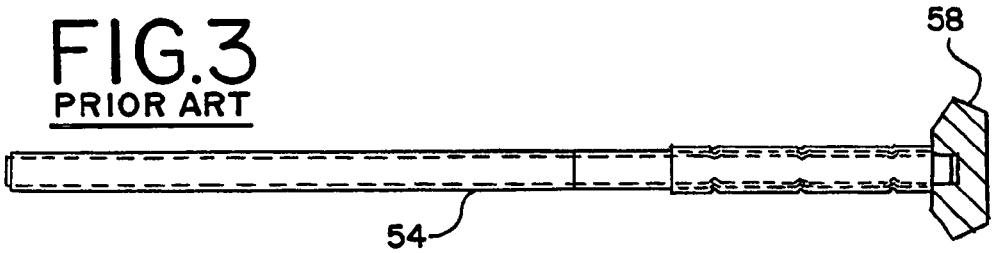
FIG.3 PRIOR ART
FIG. 3 is a side view, in partial cross section, of a prior art stopper pipe with stopper head.

Referring now to FIG. 3, a prior art stopper pipe shaft 54 is shown with stopper head 58 affixed to the end thereof. Typically, stopper pipe shaft 54 is comprised of a steel cylindrical pipe with the end press fit into an opening in stopper head 58. Stopper head 58 itself is usually comprised of a refractory sand material solidified with the use of a binder resin. A separate stopper pipe is required for each wheel poured utilizing the prior art stopper pipe 54 as the molten metal contacts the stopper pipe above stopper head 58. Such contact with molten metal acts to fuse steel stopper pipe 54 within the molten metal. Such molten metal is, upon solidification and subsequent finishing of the railroad wheel, is cut away to form an axle hub opening in the wheel. Further, it is seen that the amount of molten metal required to fill the center cavity prior to stopper head 58 being moved in contact with the upper opening to seal against the upper opening of the drag section of the mold would be significant due to the relatively small diameter of stopper pipe 54.

Figure 4:
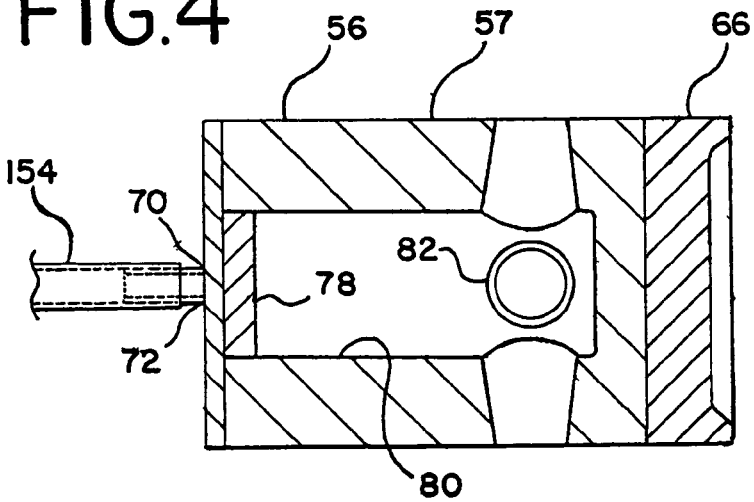
FIG. 4 is a side view, and partial cross section, of a stopper pipe assembly in accordance with the present invention.

Referring now to FIG. 4, the improved hub core assembly of the present invention is shown. Stopper pipe shaft 154 is seen to be a generally cylindrical steel pipe having an end 72 fit to an adapter within opening 70 of hub core 56. Of course, other structural shapes such as a square could function for pipe shaft 154. Hub core 56 is seen comprised a generally cylindrical structure, having a main section 57 and bottom section 66. Bottom section 66 is adapted to interface with the upper complimentary surface of drag section 50. Bottom section 66 is usually comprised of a composite graphite material. Main section 57 usually is comprised of a sand refractory material utilizing a resin binder. Hub core 56 is seen to be a generally cylindrical structure having a central opening 80. Central opening 80 is open to the outside of hub core 56 through at least one opening 82. Further top portion 76 of hub core 56 includes a plurality of openings 78.

Hub core main section 57 can also be comprised of an improved refractory material set using a resin or other setting agent and catalyst.

Figure 6:
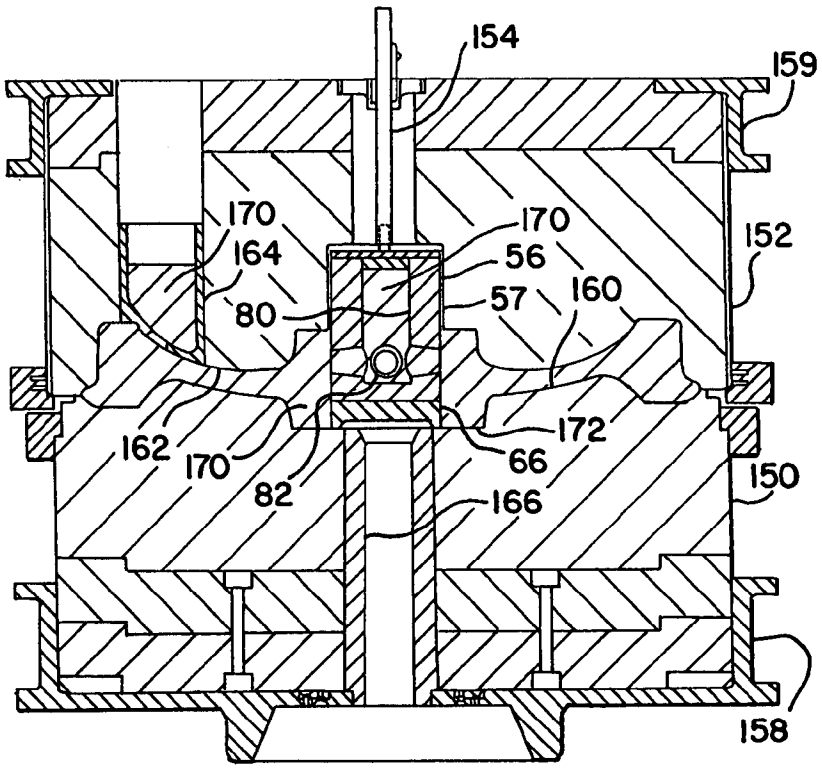
FIG. 6 is a side view, in partial cross section, of a mold assembly and hub core assembly for the bottom pressure casting of a railroad wheel, after metal enters the mold assembly, in accordance with the present invention.
Figure 5:
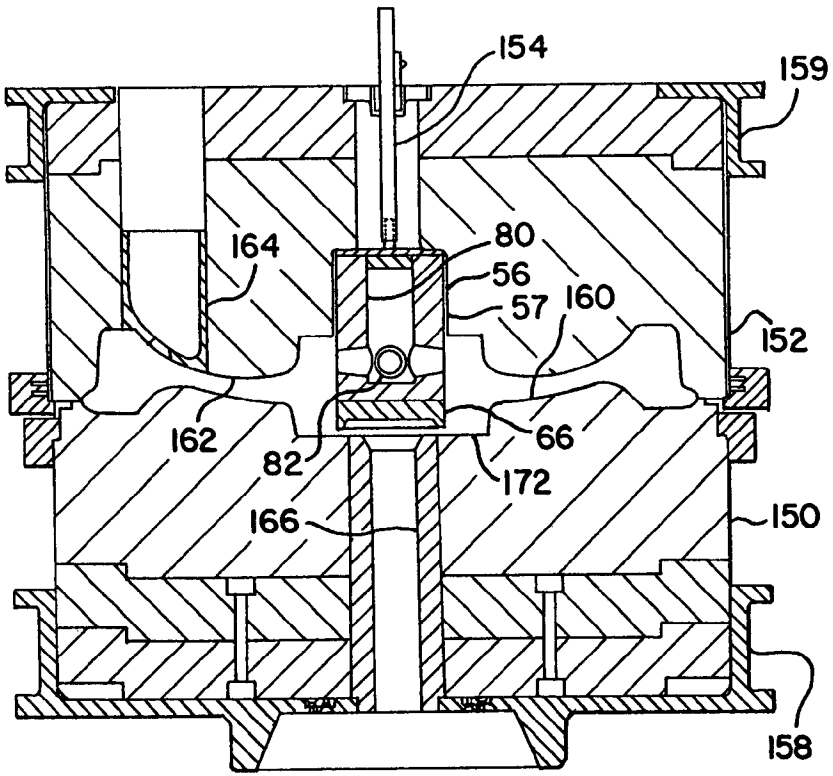
FIG. 5 is a side view, in partial cross section, of a mold assembly and hub core assembly for the bottom pressure casting of a railroad wheel, prior to metal entering the mold assembly, in accordance with the present invention.

Referring now to FIGS. 5 and 6, an assembled mold is shown for the bottom pressure casting of a railway wheel. Drag mold section 150 is held in support 158, and cope mold section 152 is held in support 159. Drag mold section 150 and cope mold section 152 are usually comprised of graphite.

Rear fan 160 of a railway wheel is machined to form a cavity in drag mold section 150. Front face of 62 of a railway wheel is machined to form a cavity in cope mold section 152. Molten steel 170 enters the cavity through opening 166 in drag mold section 150.

A plurality of risers 164 are machined into cope mold section 152 to hold liquid steel for a period of time to be able to supply molten steel 170 downwardly into the cavity after pouring. Such supply of molten steel 170 assures complete filling of the cavity and proper porosity of the steel in the railway wheel after solidification. Such risers are lined with a refractory such as sand to assure the steel in the riser remains liquid for a long enough period of time to supply the cavity with molten steel during cooling and solidification of the railway wheel.

Hub area 172 of the railway wheel also requires a supply of liquid steel to assure complete filling of the hub of the railway wheel. Hub core 56, as previously described, is present in mold hub area 172 for a few reasons. Hub core 56 is of a diameter and volume such that less molten steel is required to fill hub area 172 than if the prior art hub stopper is. This savings of steel can amount to 70 pounds of steel for a railway wheel that weighs about 1180 pounds.

From FIG. 6, it can be seen that molten steel 170 enters a central opening 80 in hub core 56 through opening 82 to form a hub riser. Hub core 56 normally has force openings 82. The hub riser has molten steel that remains molten for somewhat longer than the molten steel in contact with the graphite of the cope section 152 and drag section 150 due to the refractory material of which hub core 56 is formed having better insulating properties than the graphite of the mold.

What is claimed is:

1. A hub core assembly for use in a bottom pressure casting operation, the hub core assembly comprising an elongated pipe shaft section, a hub core affixed to one end of the pipe shaft section, the hub core being of a generally cylindrical configuration and of a diameter greater than the diameter of the pipe shaft section, the hub core positioned within a centrally located opening in a mold, wherein the hub core comprises a main section comprising a refractory material, and a lower section comprising a graphite composite material.

2. The hub core assembly of claim 1, wherein the mold is comprised of a cope section and a drag section, the centrally located opening extending through the cope section and the drag section, and wherein a lower surface of the cope section forms an opening conforming to an upper surface of an object being cast and an upper surface of the drag section forms an opening conforming to a lower surface of an object being cast, and the lower section of the hub can be moved into a sealing arrangement against the upper surface of the drag section.

3. The hub core assembly of claim 2 wherein the object being cast is a railway wheel, and the hub core forms a cylindrical opening in axial center of the railway wheel.

4. The hub core assembly of claim 2 wherein a pouring tube is present in the centrally located opening in the drag section to provide molten steel for the casting of a railway wheel.

5. The hub core assembly of claim 1 wherein the hub core comprises a main section comprised of a refractory material, the main section including a top portion and wall portion, an opening in the top portion and at least one opening in the wall portion.

6. A hub core assembly for use in a bottom pressure casting operation, the hub core assembly comprising an elongated pipe shaft section, a hub core affixed to one end of the pipe shaft section, the hub core being of a generally cylindrical configuration and of a diameter greater than the diameter of the pipe shaft section, the hub core positioned within a centrally located opening in a mold, wherein the hub core comprises a main section comprised of a refractory material, the main section including a top portion and wall portion, an opening in the top portion and at least one opening in the wall portion, wherein, upon molten metal entering the centrally located opening in the mold, the metal further enters the opening in the wall portion of the hub core to form a hub riser of molten metal.

7. A method of assembling a hub core assembly for use in a bottom pressure casting operation comprising the steps of:

providing an elongated stopper pipe, having a first end, providing a hub core and attaching the hub core to the first end of the stopper pipe, the hub core being of a generally cylindrical configuration and of a diameter greater than the diameter of the stopper pipe, providing a mold comprising a cope section and a drag section, and having an axially centrally located opening through the core section and the drag section, placing the stopper pipe and hub core into the vertical opening in the cope section, wherein the hub core includes a hollow interior section with at least one opening extending to an outer surface of the hub core, such that when molten steel enters the cavity, some molten steel enters the hub core through the openings to form a riser of molten steel within the hub core.

8. The method of claim 7 further comprising the steps of introducing molten steel under pressure through a pouring tube extending upwardly through the vertical opening in the drag section into a cavity formed in the cope section and the drag section, reducing the pressure and stopping the supply of molten steel and moving the hub core downwardly to form a seal against a bottom surface of the cavity in the drag section.

9. The method of claim 7 wherein the bottom pressure casting operation forms a railway wheel, and the hub core forms a cylindrical opening in the axial center of the railway wheel.

10. A method of casting an object comprising the steps of providing a mold having a cope section and a drag section, the cope section comprising a graphite block and the drag section comprising a graphite block, the cope section having a form of one side of the object being cast machined therein, the drag section having a form of another side of the object having cast machined therein, the cope section having a radially centrally located opening extending through its entire height, the drag section having a radially centrally located opening extending through its entire height, providing a hub core assembly comprising an elongated stopper pipe, a hub core fitting to one end of the stopper pipe, the hub core being of a generally cylindrical configuration and of a diameter greater than the diameter of the stopper pipe, positioning the hub core assembly in the opening in the cope section and the drag section of the mold, pressure pouring molten metal upwardly through the opening in the drag section and the cope section such that the molten metal enters the form of the object being cast in both the cope section and the drag section, upon cessation of pouring, moving the hub core assembly such that the hub core seals against the drag section, and wherein the molten metal contacts the hub core to allow the reuse of the hub core assembly, wherein the hub core comprises a main section comprising a refractory material, and a lower section comprising a graphite composite material.

11. The method of claim 10 wherein the hub core is comprised of a refractory material.

12. The method of claim 10 wherein the hub core comprises a main section comprised of a refractory material, the main section including a top portion and wall portion, an opening in the top portion and at least one opening in the wall portion.

13. A method of casting an object comprising the steps of providing a mold having a cope section and a drag section, the cope section comprising a graphite block and the drag section comprising a graphite block, the cope section having a form of one side of the object being cast machined therein, the drag section having a form of another side of the object having cast machined therein, the cope section having a radially centrally located opening extending through its entire height, the drag section having a radially centrally located opening extending through its entire height, providing a hub core assembly comprising an elongated stopper pipe, a hub core fitting to one end of the stopper pipe, the hub core being of a generally cylindrical configuration and of a diameter greater than the diameter of the stopper pipe, positioning the hub core assembly in the opening in the cope section and the drag section of the mold, pressure pouring molten metal upwardly through the opening in the drag section and the cope section such that the molten metal enters the form of the object being cast in both the cope section and the drag section, upon cessation of pouring, moving the hub core assembly such that the hub core seals against the drag section, and wherein the molten metal contacts the hub core to allow the reuse of the hub core assembly, wherein, upon molten metal entering the centrally located opening in the mold, the metal further enters the opening in the wall portion of the hub core to form a hub riser of molten metal.

14. A method of casting an object comprising the steps of providing a mold having a cope section and a drag section, the cope section comprising a graphite block and the drag section comprising a graphite block, the cope section having a form of one side of the object being cast machined therein, the drag section having a form of another side of the object having cast machined therein, the cope section having a radially centrally located opening extending through its entire height, the drag section having a radially centrally located opening extending through its entire height, providing a hub core assembly comprising an elongated stopper pipe, a hub core fitting to one end of the stopper pipe, the hub core being of a generally cylindrical configuration and of a diameter greater than the diameter of the stopper pipe, positioning the hub core assembly in the opening in the cope section and the drag section of the mold, pressure pouring molten metal upwardly through the opening in the drag section and the cope section such that the molten metal enters the form of the object being cast in both the cope section and the drag section, upon cessation of pouring, moving the hub core assembly such that the hub core seals against the drag section, and wherein the molten metal contacts the hub core to allow the reuse of the hub core assembly, wherein the hub core is of a length such that upon the molten metal entering and filling the form of the object being cast in the mold and the hub core sealing the opening in the form of the object being cast in the drag section, the molten metal does not directly contact the elongated stopper pipe.

15. The method of claim 10 wherein the overall diameter of the hub core is greater than the overall diameter of the elongated stopper pipe, whereby less molten metal is required to fill the form of the object being cast in the mold with the use of the hub core.

16. The method of claim 10 wherein the elongated stopper pipe is a generally cylindrical steel pipe, and the hub core is a generally cylindrical refractory material.

17. The method of claim 10 further comprising the steps of removing the hub core assembly from the mold after the object being cast has sufficiently solidified.

* * * * *